United States Patent [19]

Stafford et al.

[11] 4,421,160

[45] Dec. 20, 1983

[54] SHELL AND TUBE HEAT EXCHANGER WITH REMOVABLE TUBES AND TUBE SHEETS

[75] Inventors: Donald C. Stafford, Hinsdale; Vincent F. Allo, Warrenville, both of Ill.

[73] Assignee: Chicago Bridge & Iron Company, Oak Brook, Ill.

[21] Appl. No.: 197,482

[22] Filed: Oct. 16, 1980

[51] Int. Cl.[3] ..... F28F 9/06

[52] U.S. Cl. ..... 165/76; 165/79; 165/158; 165/175; 29/157.4; 156/344; 156/296; 156/293; 156/303.1

[58] Field of Search ..... 165/76, 79, 173, 175, 165/158; 29/157.4; 156/344, 296, 293, 303.1

[56] References Cited

U.S. PATENT DOCUMENTS

| | | | |
|---|---|---|---|
| 1,198,307 | 9/1916 | Zimmerman | 165/79 X |
| 3,471,178 | 10/1969 | Roe | 165/79 X |
| 3,605,880 | 9/1971 | Smith | 165/158 |
| 3,993,126 | 11/1976 | Taylor | 165/79 X |
| 4,117,884 | 10/1978 | Frei | 165/79 X |
| 4,295,522 | 10/1981 | Frei | 165/79 |

FOREIGN PATENT DOCUMENTS

| | | | |
|---|---|---|---|
| 731431 | 6/1955 | United Kingdom | 165/173 |
| 425038 | 10/1974 | U.S.S.R. | 165/79 |

*Primary Examiner*—Albert W. Davis, Jr.
*Attorney, Agent, or Firm*—Merriam, Marshall & Bicknell

[57] ABSTRACT

A heat exchanger having a plurality of spaced apart tubes loosely penetrating aligned oversized holes in two spaced apart tube sheets; a shell around the tube sheets; each tube sheet being secured against inward displacement axial to the tubes by contact with stop means on the shell; each tube sheet being barred against outward displacement axial to the tubes by keys mechanically engaging the tube sheet and shell so that upon release of the keys they no longer bar removal of the tube sheet from the shell; a solid binder joining and sealing the tubes to the tube sheet and joining and sealing the tube sheet to the shell, with said solid binder having substantial compressive, tensile and shear strength, and being convertible by heat at a sufficiently high temperature to a physical state in which it has much lower compressive, tensile and shear strength; a conduit to deliver a heat exchange fluid around the tubes inside of the shell between the tube sheets; and a conduit to deliver a liquid feed stream into a feed box partially defined by one of the tube sheets.

11 Claims, 8 Drawing Figures

96
98
94
84
90
7
8
110
92
80
88
82
86
104
106
102
500
128
124
126
118
122
116
120
114
112
108
400

SHELL AND TUBE HEAT EXCHANGER WITH REMOVABLE TUBES AND TUBE SHEETS

This invention relates to heat exchangers. More particularly, this invention is concerned with improvements in shell and tube heat exchangers which permit non-destructive removal and replacement of each tube in the heat exchanger.

BACKGROUND OF THE INVENTION

Heat exchangers are widely used in many processing operations. One type of heat exchanger in wide use is generally referred to as a shell and tube heat exchanger. Such a heat exchanger has at least one tube extending between and through two spaced apart tube sheets surrounded by a shell. The shell is provided with an inlet and an outlet as that a suitable heat exchange fluid can be circulated through the shell to cool or heat as a fluid flowing through each tube. Each end of the shell can be left open for use in some processing operations and for others one or both ends of the shell can be closed, such as by a removable cover. Closing of one end of the shell to provide an enclosed feed box space is quite common. In addition, when the heat exchanger is to be used at high temperatures, the other shell end is usually also closed to provide a fluid collecting box to which fluid exits after flowing through each tube. Of course, the feed box is provided with a suitable feed inlet and the collecting box is provided with an outlet.

Although shell and tube heat exchangers are generally used to heat a liquid stream, they are also useful for cooling such a stream. When used for cooling purposes, each tube outlet end can be closed, or it can also be left open or uncovered so that the effluent can exit unrestrictedly into a suitable receptacle. Similarly, the tube inlet end can be enclosed or it can be left open and the liquid to be cooled fed to the tube by any suitable means. Thus, a wier can be provided around the tube sheet so that a pool of liquid is formed and flows into the open mouth of each tube.

Shell and tube heat exchangers of the described types can be used for producing fresh water from brackish water and sea water, for concentrating fruit and vegetable juices, and in industrial crystallization processes. As the liquid flows through each tube it can be cooled enough to crystallize out a solid from the liquid. Thus, by cooling sea water, ice is obtained which when separated, washed and melted provides potable water. When a fruit or vegetable juice is similarly chilled, ice forms and is removed thereby providing a concentrated juice.

The copending United States patent applications of Engdahl et al Ser. No. 160,112 filed June 16, 1980 and now U.S. Pat. No. 4,286,436 issued Sept. 1, 1981 and Engdahl Ser. No. 160,002, filed June 16, 1980 and now U.S. Pat. No. 4,314,455 issued Feb. 9, 1982, disclose heat exchangers (also called freeze exchangers) for cooling liquids. The disclosure of those patent applications is incorporated herein by reference.

The tubes of freeze exchangers, which are a species of heat exchanger, must have a surface which discourages ice from sticking to the tube. Stainless steel tubes with highly polished surfaces are suitably used in freeze exchangers. However, if the polished surface deteriorates to such an extent that ice sticks there could be a loss of efficiency and ultimately plugging of the tube.

Shell and tube heat exchangers (including freeze exchangers) are manufactured with the tubes permanently joined to the tube sheets by welding or by a tube expansion method. Permanent installation of the tubes makes it very difficult and expensive to repair a heat exchanger if a tube leaks, corrodes or becomes plugged. Generally, removal of a tube involves destruction of the tube, and sometimes destruction of adjacent tubes to provide access. In addition, damage to the tube sheets often results.

It has been proposed to use undersized tube sheets with oversized holes and to secure the tube sheets in the shell, and the tubes in the holes, with a solid polymeric material, such as an epoxy resin. Removal of the tubes and tube sheets is to be achieved by applying heat to the polymeric material to melt or degrade it. A heat exchanger fabricated in this manner, however, may not qualify under accepted engineering standards and codes pertaining to heat exchangers because of the present insufficient performance data on solid polymeric materials for the conditions they will be subjected to during heat exchanger operation. If the polymeric material securing the tubes in place in the tube sheets were to fail, and the tubes slip, the restraining force exerted by the tubes to the tube sheets, to which they are connected at each end, would be lost. All the pressure of the heat exchange fluid on the shell side would then be exerted against the tube sheets and only the polymeric material binding it to the shell would be available to resist the pressure. Because the behavior of the polymeric materials is not thoroughly known, a sudden and dangerous tube sheet failure could result.

A need accordingly exists for tube and shell heat exchangers having readily removable tubes secured in place by tube sheets which function as internal structural members, and desirably meet ASME codes and other safety standards.

SUMMARY OF THE INVENTION

According to the invention there is provided a heat exchanger comprising a plurality of spaced apart tubes loosely penetrating aligned oversized holes in two spaced apart tube sheets; a shell around the tube sheets; each tube sheet being secured against inward displacement axial to the tubes by contact with stop means on the shell; each tube sheet being barred against outward displacement axial to the tubes by releasable restraining means mechanically engaging the tube sheet and shell so that upon release of the restraining means it no longer bars removal of the tube sheet from the shell; a solid binder joining and sealing the tubes to the tube sheet and joining and sealing the tube sheet to the shell, with said solid binder having substantial compressive, tensile and shear strength, and being convertible by heat at a sufficiently high temperature to a physical state in which it has much lower compressive, tensile and shear strength; means to deliver a heat exchange fluid around the tubes inside the shell between the tube sheet; and means to deliver a liquid feed stream into a feed box partially defined by one of the tube sheets.

The shell, tube sheets and tubes are desirably made of metal. Carbon steel, stainless steel, aluminum, copper and brass are some of the metals of which these components of the heat exchanger can be made.

The releasable restraining means mechanically engaging the tube sheet and shell is also desirably made of metal so as to assure that the tube sheets will be held in place even if the binder joining the tubes to the tube sheets fails and the tubes no longer function as tension members between the tube sheets.

A cover can be joined to one end of the shell. A liquid feed box can be located between the cover and an adjacent tube sheet.

Any suitable binder can be used although a solid polymeric material is desirably employed. An epoxy resin is preferably used, and especially a liquid resin which is room temperature catalyzed. A commercially available epoxy resin which can be used is marketed as Chockfast Orange 610-TCF by Philadelphia Resin Company. However, thermoplastic and thermosetting resins are also suitably used. Regardless of which polymeric material is used, it should liquefy or degrade upon heating to an elevated temperature, which does not damage the shell, tube sheets to tubes, so that one or more of the tubes can be removed for repair or replacement.

One or both of the tube sheets can be secured against inward displacement by having its peripheral edge portion inwardly supported by a ledge on the shell inner wall. Furthermore, the releasable restraining means can be a plurality of keys set in slots in the shell wall.

One or more of the tube sheets can comprise a plurality of spaced apart metal plates separated by spacers and the space between plates occupied by the binder.

Either or both of the tube sheets can be insulated against heat transfer therethrough. Thus, a tube sheet can be insulated against heat transfer therethrough by a sheet of insulation, such as a sheet of insulation supported by a ledge inside of the shell near the tube sheet. A spacer can be placed between the sheet of insulation and the tube sheet. The space between the two can be occupied by the binder.

DETAILED DESCRIPTION OF THE DRAWINGS

To the extent it is practical, the same or similar elements which are illustrated in the various views of the drawings will be identified by the same numbers.

Figure 1:
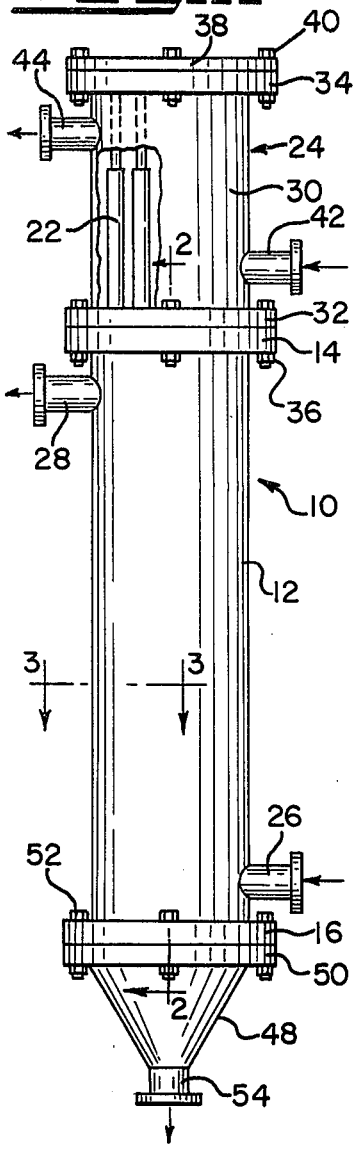
FIG. 1 is an elevational view of a falling film heat exchanger, according to the invention, having top and bottom tube sheet assemblies.

With reference to FIG. 1, the vertical heat exchanger 10 has a circular cylindrical metal shell 12 having a top flange 14 and a bottom flange 16. A plurality of vertical tubes 18, generally of metal and of the same size, are positioned inside of shell 12. The lower end 20 (FIG. 2) of the tubes 18 extend slightly lower than the bottom flange 16. However, the upper ends 22 (FIG. 1) of tubes 18 extend upwardly into the feed box 24 mounted on the top of the heat exchanger 10. Inlet 26 near the bottom of shell 12 is used to deliver a heat exchange fluid to the shell side of the heat exchanger 10 and outlet 28 is used to remove the heat exchange fluid therefrom.

Feed box 24 has a circular cylindrical body 30 to which lower flange 32 and upper flange 34 are joined. Lower flange 32 is removably secured to shell flange 14 by bolts 36. Cover 38 is removably attached to feed box upper flange 34 by bolts 40. A liquid to be processed in the heat exchanger 10 is supplied to feed box 24 by feed inlet 42. The excess feed, if any, can be removed by feed outlet 44 and then be recirculated to inlet 42.

A conical reducer 48 having flange 50 is removably connected to shell bottom flange 16 by bolts 52. Liquid flowing out of the lower ends 20 of tubes 18 is directed by conical reducer 48 to outlet 54 for delivery to a predetermined destination.

Figure 2:
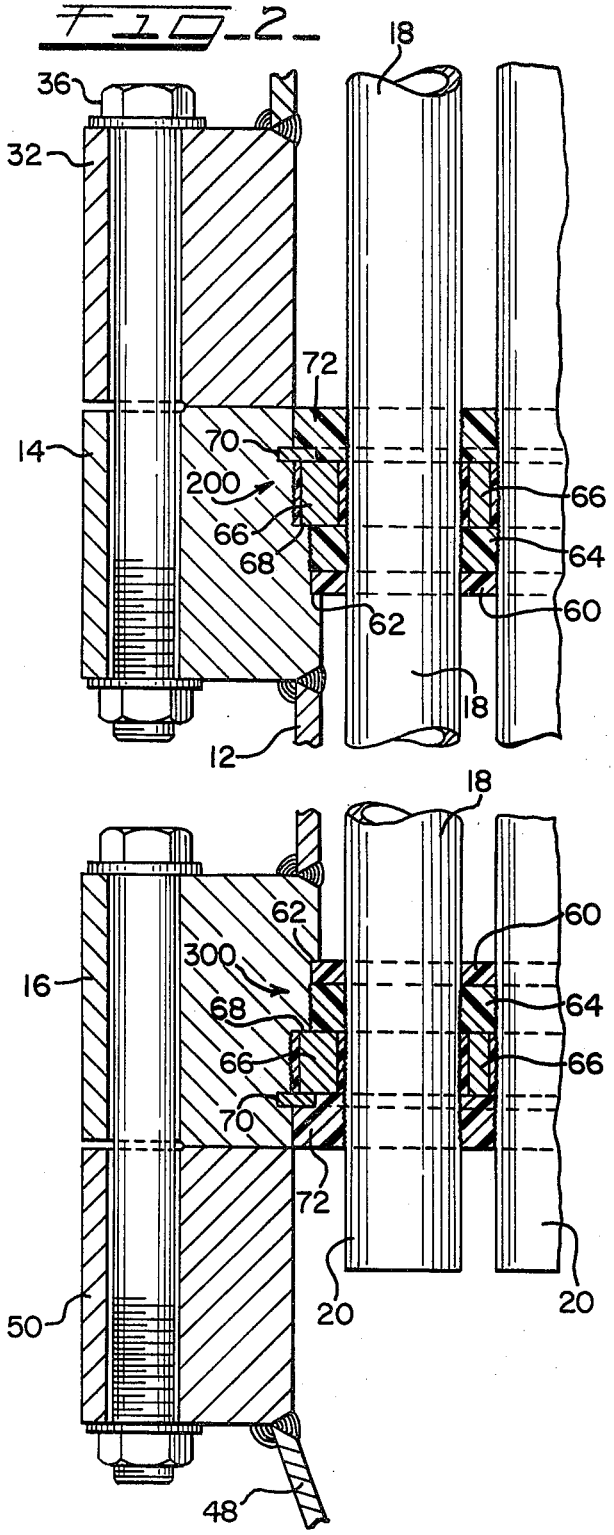
FIG. 2 is a sectional view taken along the line 2—2 of FIG. 1 and illustrates the top and bottom tube sheet assemblies.
Figure 4:
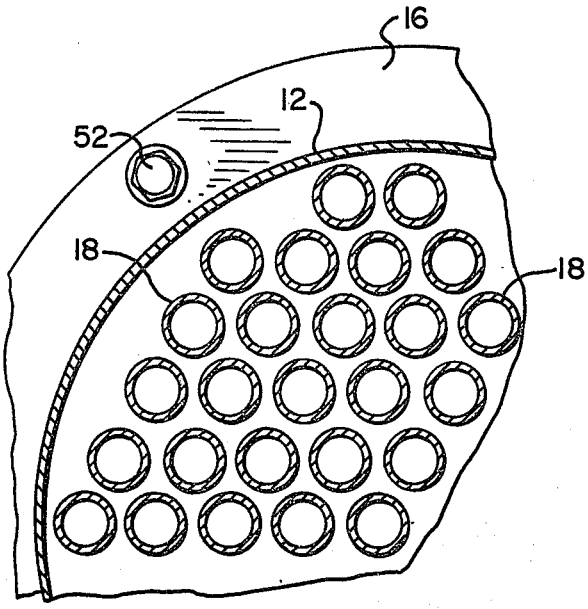
FIG. 4 is an enlarged view of the tube arrangement shown in FIG. 3.

FIG. 2 illustrates the top tube sheet assembly 200, and the bottom tube sheet assembly 300, in the heat exchanger 10. Each of the assemblies 200 and 300 is the same as the other except that the bottom assembly 300 is upside-down with respect to the top assembly 200.

Figure 3:
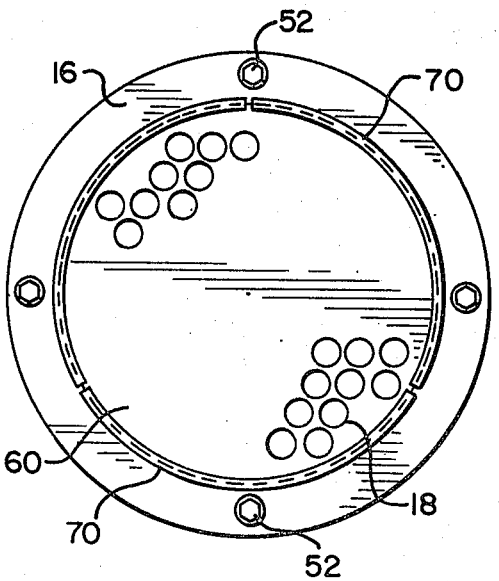
FIG. 3 is a sectional view taken along the line 3—3 of FIG. 1 and shows keys holding the tube sheet in place and the positioning of the tubes.

Each of the assemblies 200 and 300 is illustrated with an optional insulating layer 60 in the form of a circular disc with holes for the tubes 18. Insulating layer 60 is positioned adjacent ledge 62 in the flanges 14 and/or 16. A layer of polymeric material 64, such as an epoxy resin, is positioned adjacent insulating layer 60. Metal tube sheet 66 is then put in place against ledge 68 in flange 14 and/or 16. Metal tube sheet 66 is desirably put in place while the polymeric material 64 is liquid and is solidifying in place. A series of metal keys 70 are then positioned in a groove cut in the inner radial surface of flanges 14 and/or 16. The keys 70 can be segments of a metal ring and of any suitable arcuate length. FIG. 3 shows the use of four nearly quarter circle keys. Once the keys 70 are put in place, a layer of polymeric material 72 is positioned against the keys 70 and the tube sheet 66 to thereby make a monolithic structure out of the tube sheet assembly.

It should be understood that desirably only one of the tube sheet assemblies 200 and 300 is assembled at a time so that the polymeric material used for layers 64 and 72, and to fill the space around the undersized tube sheet 66, having oversized holes for the tubes, can be solidified in place without flowing away. If desired, the surface of the tubes can be roughened or scored to enhance bonding of the polymeric material thereto.

Figure 5:
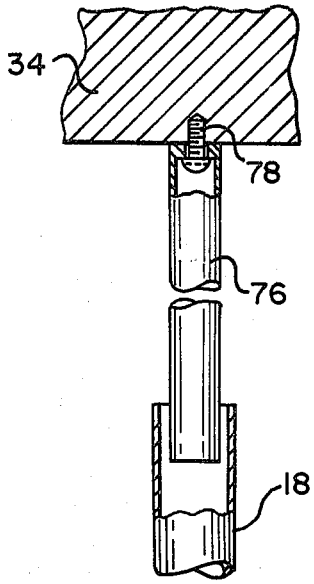
FIG. 5 is an elevational view, partly in section, illustrating an insert positioned in a tube mouth to regulate liquid flow into the tube.

As shown in FIG. 5, liquid flow into the top of the tubes 18 can be controlled to provide a uniform falling film by tubular inserts 76 which telescope into the top portion of tubes 18 for a short distance. Tubular inserts 76 are fastened to the lower surface of flange 34 by machine bolts 78.

The described heat exchanger as illustrated in FIGS. 1 to 5 provides for ready removal of the tubes 18 since the polymeric material used for layers 64 and 72 can be removed by the application of heat. Of course, the keys 70 and tube sheet 66 can also be removed once the polymeric material has been degraded or removed by heating. However, since the tube sheet 66 is mechanically secured in place to the shell portion of the heat exchanger by keys 70, no sudden failure of the heat exchanger can occur at the tube sheet even if the polymeric material around and adjacent to the tubes and tube sheets fails.

Figure 8:
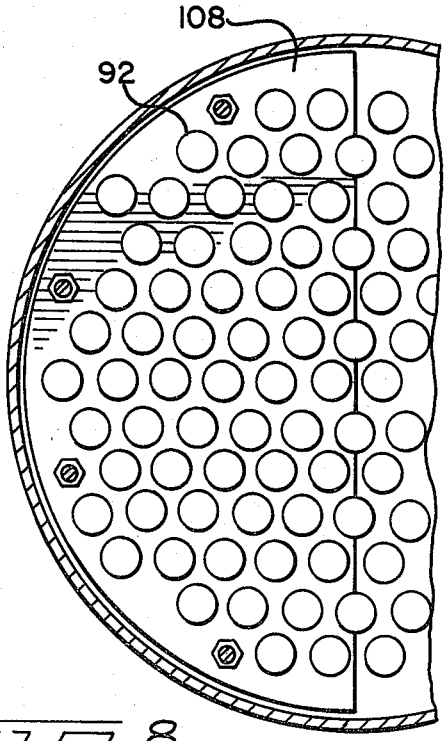
FIG. 8 is a sectional view taken along the line 8—8 of FIG. 7 and shows one of the semi-circular tube supports.
Figures 6, 7:
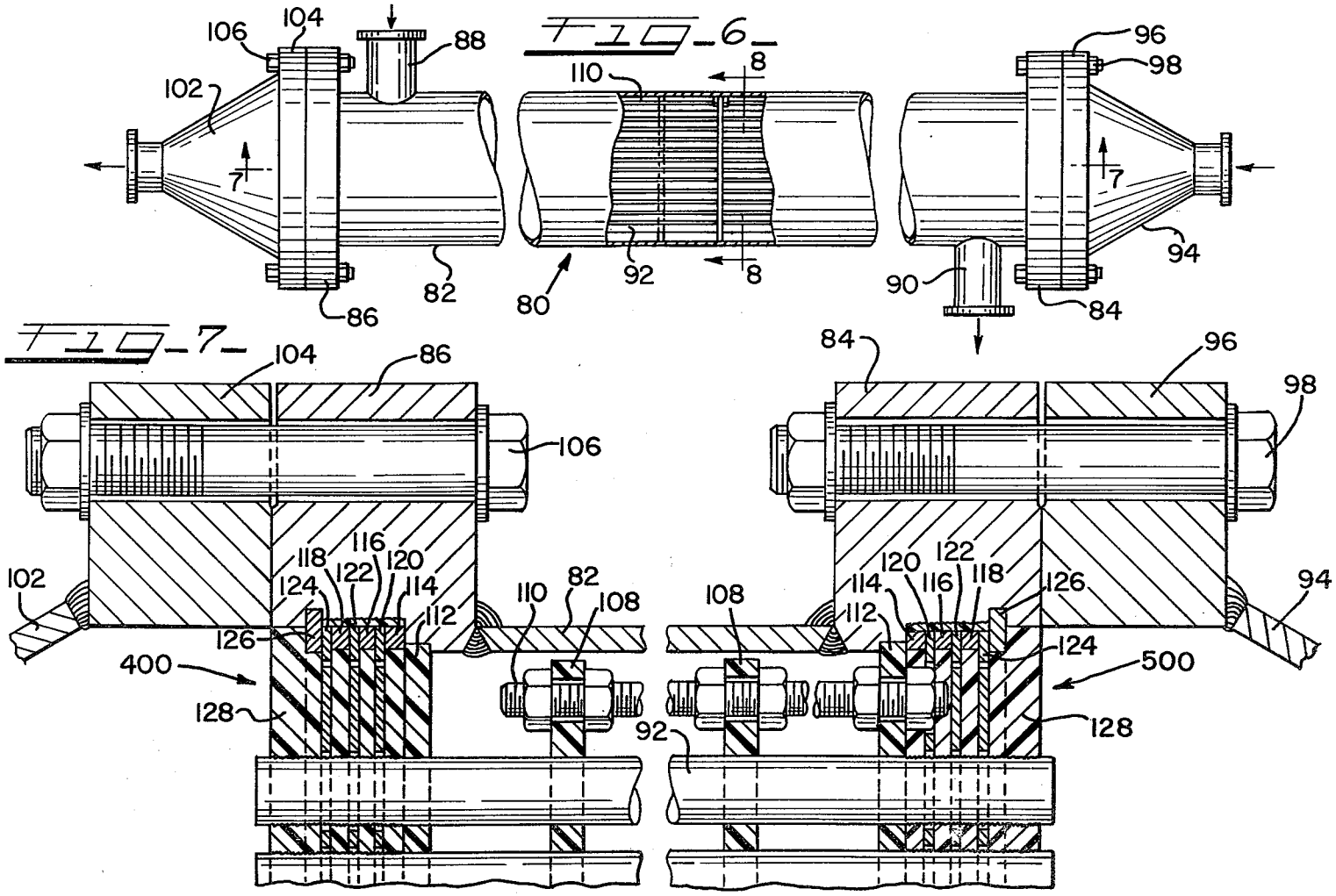
FIG. 6 is a side elevational view of a horizontal heat exchanger according to the invention.
FIG. 7 is a sectional view taken along the line 7—7 of FIG. 6 and illustrates the tube sheet construction at each end of the heat exchanger.

FIGS. 6 to 8 illustrate the invention is applied to a horizontal heat exchanger. The horizontal heat exchanger 80 has a circular cylindrical shell 82 with a flange 84 at one end and a flange 86 at the other end. Inlet 88 feeds a heat exchanger fluid to the shell side of the heat exchanger and the heat exchange fluid is removed by outlet 90. A plurality of tubes 92 is axially located in shell 82 and the tube ends are supported by tube sheet assemblies 400 and 500 (FIGS. 6 to 8).

The inlet end of the heat exchanger includes a conical member 94 having a flange 96 which is removbly connected by bolts 98 to flange 84. Similarly, the outlet end of the heat exchanger has a conical member 102 having flange 104 which is removably joined by bolts 106 to flange 86.

Two or more staggered tube supports 108 are used to support the tubes 92 intermediate their ends. Each tube support 108 is a semicircular disc through which the tubes extend. They are positioned on opposite sides of a vertical line axial of the heat exchanger. Threaded rods 110 serve to hold the supports 108 in place. One end of rods 110 is joined to one of the two insulating plates 112 which rest on a ledge in each of the flanges 84 and 86.

The tube sheet assemblies 400 and 500 are mirror images of one another in all respects. Each tube sheet assembly has three metal rings 114,116 and 118 separated by three metal tube sheets 120,122 and 124. The metal ring 114 contacts a supporting ledge in the flange 84 and/or 86. A plurality of metal keys 126 are set in a groove cut in the inside surface of the flanges 84 and 86. The keys 126 are in contact with the tube sheet 124. As a result there is metal continuing from the keys to the flange ledge against which ring 114 rests. In this way each tube sheet assembly is secured in place.

The space between the tube sheets 120, 122 and 124, and the space inside of rings 114, 116 and 118 is filled with a polymeric material 128, such as an epoxy resin polymerized in place. The same polymeric material fills the space radial of the keys and beyond the keys as well as around the tubes and tube sheets to thereby bind the assemblies together in a fluid tight manner. The oversized holes in the tube sheets through which the tubes extend, and the space around the periphery of the radially undersized tube sheets, is filled with the polymeric material.

Because of the mechanical securement achieved by the keys 126, the tube sheet assemblies are able to withstand substantial internal pressures developed on the shell side of the heat exchanger by a heat exchange fluid, such as ammonia, used to cool a feed stream. No sudden failure of the tube sheets will result even if the polymeric material fails since the tube sheets will remain in place.

It should be understood that the tubes and tube sheets can be removed from the horizontal heat exchanger without damaging them by applying sufficient heat to degrade or melt the polymeric material.

The foregoing detailed description has been given for clearness of understanding only, and no unnecessary limitations should be understood therefrom as modifications will be obvious to those skilled in the art.

What is claimed is:

1. A heat exchanger comprising:

a plurality of spaced apart tubes loosely penetrating aligned oversized holes in two spaced apart metal tube sheets;

a shell around the tube sheets;

each tube sheet being secured against inward displacement axial to the tubes by contact with stop means on the shell;

each tube sheet being barred against outward displacement axial to the tubes by releasable restraining means mechanically engaging the tube sheet and shell so that upon release of the restraining means it no longer bars removal of the tube sheet from the shell;

a polymeric solid binder covering the tube sheet outer surface and the restraining means and joining and sealing the tubes to the tube sheet and joining and sealing the tube sheet to the shell, with said solid binder having substantial compressive, tensile and shear strength, and being convertible by heat at a sufficiently high temperature to a physical state in which it has much lower compressive, tensile and shear strength;

means to deliver a heat exchange fluid around the tubes inside of the shell between the tube sheets; and means to deliver a liquid feed stream into a feed box partially defined by one of the tube sheets.

2. A heat exchanger according to claim 1 including a cover joined to one end of the shell.

3. A heat exchanger according to claim 2 in which a liquid feed box is between the cover and the adjacent tube sheet.

4. A heat exchanger according to claim 1 in which the tube sheets are insulated against heat transfer therethrough.

5. A heat exchanger according to claim 1 in which a tube sheet is secured against inward displacement by having its peripheral edge portion inwardly supported by a ledge on the shell inner wall.

6. A heat exchanger according to claim 1 in which the releasable restraining means is a plurality of keys set in slots in the shell wall.

7. A heat exchanger according to claim 1 in which the binder substantially surrounds each tube sheet.

8. A heat exchanger according to claim 1 in which a tube sheet comprises a plurality of spaced apart plates separated by spacers and the space between plates is occupied by the binder.

9. A heat exchanger according to claim 4 in which a tube sheet is insulated against heat transfer therethrough by sheet of insulation supported by a ledge inside of the shell near the tube sheet.

10. A heat exchanger according to claim 9 including a spacer between the sheet of insulation and the tube sheet.

11. A heat exchanger according to claim 9 in which the tube sheet is spaced from the sheet of insulation and the space is occupied by said binder.

* * * * *

UNITED STATES PATENT AND TRADEMARK OFFICE

CERTIFICATE OF CORRECTION

PATENT NO. : 4,421,160

DATED : December 20, 1983

INVENTOR(S) : DONALD CLAUDE STAFFORD AND VINCENT F. ALLO

It is certified that error appears in the above-identified patent and that said Letters Patent are hereby corrected as shown below:

Column 1, line 18, change "as" to --so--; line 19, delete "as"; column 2, line 58, change "sheet" to --sheets--; column 3, line 16, change "to" to --or--; column 5, line 13, change "removbly" to --removably--; column 6, line 55, before "sheet" insert --a--.

Signed and Sealed this

*Twenty-eighth* Day of *February 1984*

[SEAL]

*Attest:*

GERALD J. MOSSINGHOFF

*Attesting Officer*

*Commissioner of Patents and Trademarks*